US010176953B2

(12) United States Patent
Jefferies et al.

(10) Patent No.: US 10,176,953 B2
(45) Date of Patent: Jan. 8, 2019

(54) WELD RESISTANT CONTACTOR

(71) Applicant: Schneider Electric USA, Inc., Andover, MA (US)

(72) Inventors: Kevin M Jefferies, Raleigh, NC (US); Benjamin W Edwards, Rolesville, NC (US); Matthew L White, Cary, NC (US); Alan E Freeman, Raleigh, NC (US); Richard Karl Weiler, Wake Forest, NC (US)

(73) Assignee: SCHNEIDER ELECTRIC USA, INC., Andover, MA (US)

( * ) Notice: Subject to any disclaimer, the term of this patent is extended or adjusted under 35 U.S.C. 154(b) by 0 days.

(21) Appl. No.: 15/279,629

(22) Filed: Sep. 29, 2016

(65) Prior Publication Data

US 2018/0090291 A1 Mar. 29, 2018

(51) Int. Cl.

| | |
|---|---|
| ***H01H 51/26*** | (2006.01) |
| ***H01H 50/54*** | (2006.01) |
| ***H01H 3/22*** | (2006.01) |
| *H01H 1/54* | (2006.01) |
| *H01H 5/02* | (2006.01) |
| *H01H 5/06* | (2006.01) |

(52) U.S. Cl.

CPC ..... *H01H 50/546* (2013.01); *H01H 3/222* (2013.01); *H01H 1/54* (2013.01); *H01H 5/02* (2013.01); *H01H 5/06* (2013.01)

(58) Field of Classification Search

CPC ..... H01H 51/26; H01H 51/2209; H01H 51/2227; H01H 2051/2218

See application file for complete search history.

(56) References Cited

U.S. PATENT DOCUMENTS

| | | | | |
|---|---|---|---|---|
| 4,593,260 A * | 6/1986 | Guero | H01H 77/101 335/147 |
| 5,959,517 A * | 9/1999 | Wieloch | H01H 81/04 218/22 |
| 8,269,585 B2 * | 9/2012 | Choi | H01H 1/2008 335/126 |

* cited by examiner

*Primary Examiner* — Bernard Rojas
(74) *Attorney, Agent, or Firm* — Locke Lord LLP

(57) ABSTRACT

In an electromagnetically controlled actuator of an electrical contactor, switching is done by the actuator with a set of fixed contacts and a set of movable contacts. The movable contacts are carried on a movable contact carrier. The movable contact carrier is coupled to and driven by an armature surrounded by a coil. The armature carries a coupling shaft, and the coupling shaft carries at least part of a bistable coupling mechanism which joins the armature to the movable contact carrier and allows the movable contact carrier and armature to keep the fixed and movable contacts separated when a short circuit current creates a contact welding situation.

9 Claims, 4 Drawing Sheets

WELD RESISTANT CONTACTOR

BACKGROUND OF THE INVENTION

1. Field of the Invention

The present invention relates to the field of contactors and specifically to contactor actuators.

2. Discussion of Related Art

A "contactor" is an electrically controlled switch used for switching an electrical power circuit, similar to a relay except with higher current ratings. An electromagnetic 'actuator' is typically that part of the contactor mechanism which electrically controls the switching, i.e. opening and closing the electrical contacts of the switch. When a contactor is used for handling high currents to power hungry loads, such as electric motors, faults in the power supply may create abnormally high or so-called "short circuit" currents leading to a situation where the switch contacts are fused, i.e. welded, together as discussed below.

The person of ordinary skill in the art will understand that known contactors are typically equipped with some sort of spring to take up any decrease in electrical contact thickness as the contacts wear. The force needed to compress these springs must be generated by the actuator. When the contactor is closed in normal operation, the contacts have electrical continuity, and the contact spring is not fully compressed.

The movable contacts, also known as "bridging contacts," and the contact springs are usually carried by a movable contact carrier, also sometimes known as a "rake," of the electromagnetic actuator. The movable contact carrier is moved by the electromagnet's armature. Under normal operating conditions, the armature of the actuator thus controls the contact position, i.e., open or closed.

However, short circuit current through the contact pair is often two to three orders of magnitude greater than the rated current carrying capacity of the contactor. These short circuit currents produce significant magnetic repulsion forces between the contacts, which can cause the contacts to "blow open," compressing the spring to its solid height, and initiating a plasma arcing between the contacts. When the short circuit current ends, e.g. a protective circuit breaker trips, the magnetic repulsion stops, and the contact spring of a known contactor actuator pushes the contact pair back together. The blown open contacts, however, will have been subjected to the intense heat of the arc, and their surface metal may be in a liquid, molten, state when they come back into contact. Then, as the contacts cool below the melting point of the contact metal they can weld together such that the actuator can no longer open them, and control of the load is lost.

Thus there is a need for improved contactor operation to prevent contact welding.

SUMMARY OF THE INVENTION

In the invention the moveable contacts and the armature of the contactor actuator are mechanically decoupled from one another by using a bistable connection such as a set of permanent magnets on the movable contact carrier and on a coupling shaft of the armature. Thus in normal operation the movable contacts will follow the armature and have common movement therewith to operate normally in a first position in relation to one another. But, in extraordinary cases, the movable contacts and armature will assume a second position in relation to one another preventing a welding together of molten contacts by allowing the movable contacts to blow open, and stay open, when a short circuit occurs. The polarity of the permanent magnets enables two stable positions the contacts can adopt. If enough force, e.g. from a short circuit current, is placed on the contacts to push them apart, they will move from one position (closed) to the other position (open) independent of the armature position and remain open until being reset to avoid coming together in a molten state to weld together.

In certain aspects the present invention will include an electromagnetically controlled actuator for an electrical contactor comprising: a) a set of fixed contacts for electrical coupling to a load; b) a movable contact carrier with contacts on a top side for meeting the fixed contacts and a body forming a tubular cavity on a bottom side, the cavity having a wall; c) an actuator with a coil and i) a movable armature actuated by the coil, and ii) a coupling shaft fixedly attached to the armature and extending upwardly therefrom toward the movable contact carrier, and d) a bistable coupling mechanism for holding the coupling shaft in one of two positions in relation to the cavity wall on the bottom side of the movable contact carrier.

In certain aspects the electromagnetically controlled actuator may be arranged wherein the two positions include a first position which allows the movable contacts to touch the fixed contacts and a second position which does not allow the movable contacts to touch the fixed contacts.

In other aspects the electromagnetically controlled actuator may be arranged wherein the two positions include the first position being a normal operation position of the movable contact carrier and the second position being a blown open position of the movable contact carrier.

In other aspects the electromagnetically controlled actuator may be arranged wherein the bistable coupling mechanism is magnetic with: the cavity wall of the movable contact carrier having a magnet therein with a top side of south polarity and a bottom side of north polarity, and the coupling shaft of the armature having a magnet thereon with a top side of north polarity and a bottom side of south polarity. In related aspects the electromagnetically controlled actuator may be arranged wherein the coupling shaft, the armature, and the coil are surrounded by a case. In further related aspects the electromagnetically controlled actuator may be arranged to have the cavity wall of the movable contact carrier fitting over an extended portion of the actuator case containing the actuator coupling shaft.

In other aspects the electromagnetically controlled actuator may be arranged wherein the bistable coupling mechanism is an over-center mechanism with springs and linkages having one end attached to the coupling shaft and the other end connected to the cavity wall of the movable contact carrier.

In other aspects the electromagnetically controlled actuator may be arranged to have a load connected to the fixed contacts. In related aspects the electromagnetically controlled actuator may be arranged wherein the load is a motor.

BRIEF DESCRIPTION OF THE DRAWINGS

The foregoing and other advantages of the disclosed embodiments will become apparent upon reading the following detailed description and upon reference to the drawings, wherein.

DETAILED DESCRIPTION

As an initial matter, it will be appreciated that the development of an actual commercial application incorporating aspects of the disclosed embodiments will require many implementation specific decisions to achieve the developer's ultimate goal for the commercial embodiment. Such implementation specific decisions may include, and likely are not limited to, compliance with system related, business related, government related and other constraints, which may vary by specific implementation, location and from time to time. While a developer's efforts might be complex and time consuming in an absolute sense, such efforts would nevertheless be a routine undertaking for those of skill in this art having the benefit of this disclosure.

It should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "top," "bottom," "left," "right," "upper," "lower," "down," "up," "side," and the like, used in the written description are for clarity in specific reference to the drawings and are not intended to limit the scope of the invention.

Figure 1:
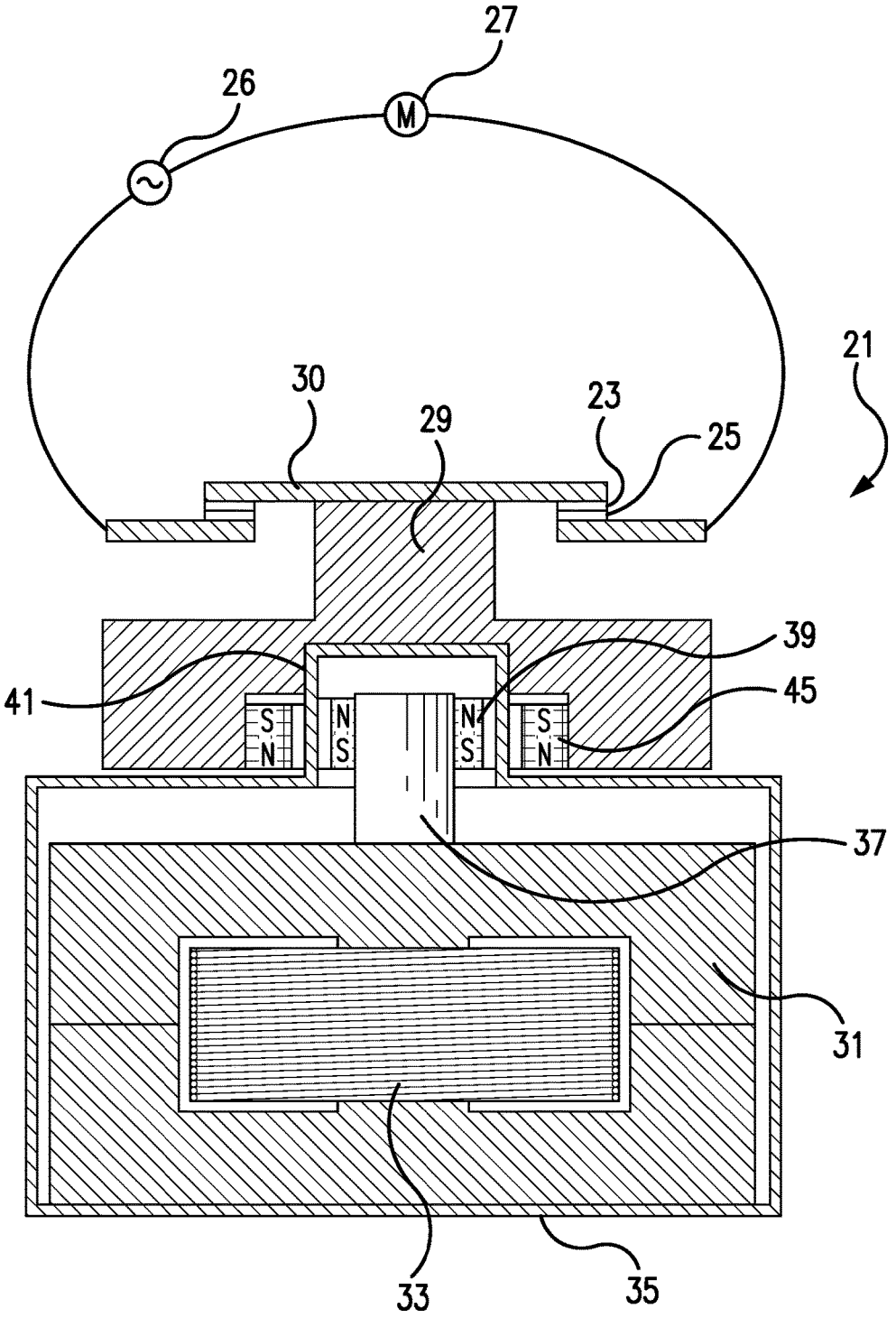
FIGS. 1 and 2 are cross sectional views of a contactor actuator of the present invention in the normal operating positions of closed and open, i.e. ON and OFF, respectively.
Figure 2:
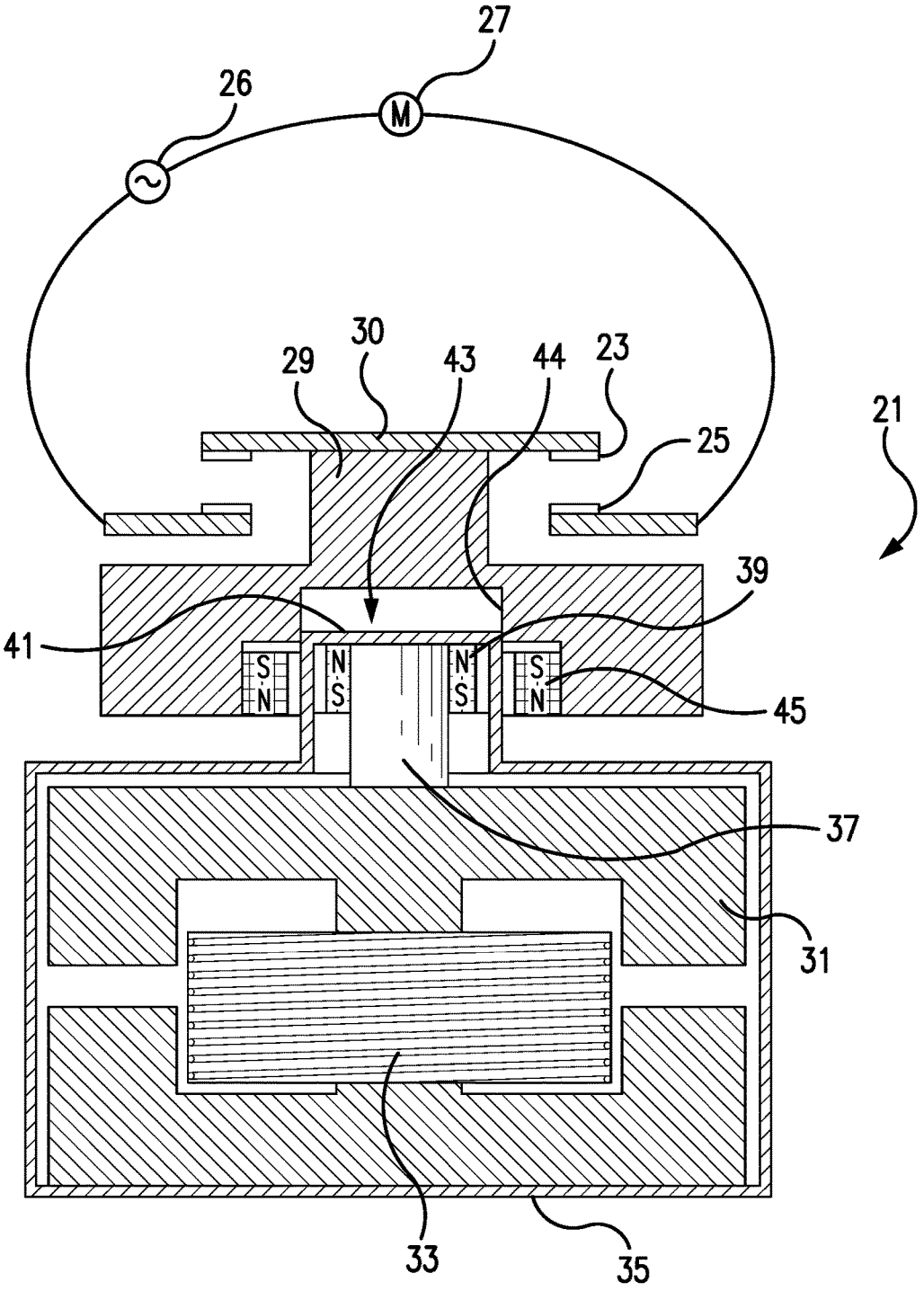
Figure 3:
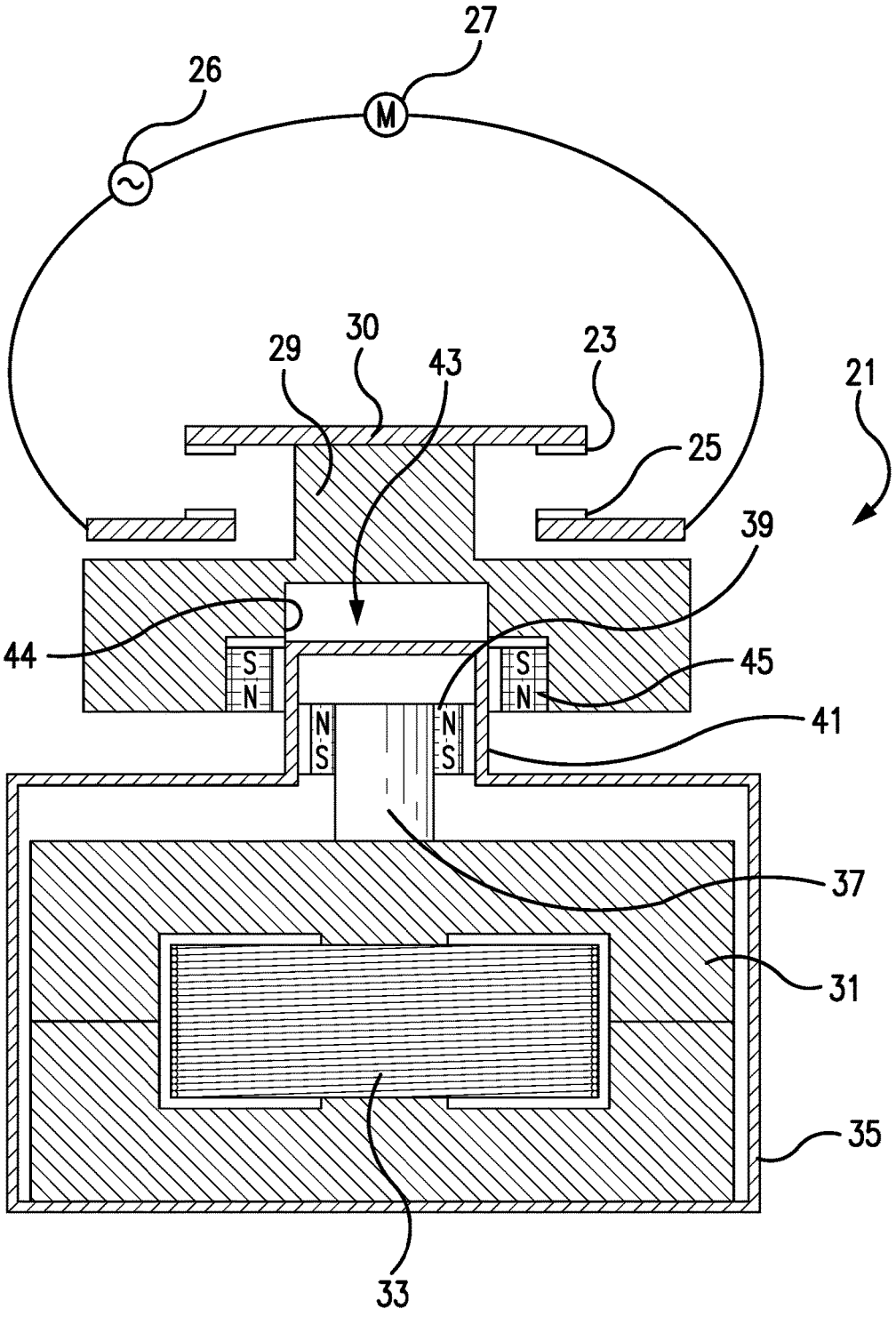
FIG. 3 is a cross sectional view of a contactor actuator of the present invention in the blown open position after being subjected to a short circuit current.

FIGS. 1-3 show one aspect of the invention in three different fundamental positions. FIG. 1 illustrates the actuator 21 holding the movable contacts 23 against the fixed contacts 25. The fixed contacts 25 will typically be electrically connected to the AC voltage source 26 and the load 27, here indicated as a motor. While only one contact set for a single phase is shown for explanatory purposes, the person of ordinary skill in the art will appreciate that multiple phase power is of course contemplated to be used with the teachings of the present invention. The movable contacts 23, as part of the actuator 21, are carried on a movable contact carrier 29 between the open and closed positions of the contacts 23, 25. The movement of the movable contact carrier 29, the frame of which is typically nonconductive outside of its conductive contact area 30, is controlled by an armature 31 in the actuator. The armature 31 is a body of ferromagnetic material drawn to the closed position by the passing of current through a coil 33 within the case 35 of the actuator 21. The armature 31 has a coupling shaft 37 extending from the top thereof. On and around the coupling shaft 37 is mounted a permanent magnet 39, typically, although not necessarily, annular in form and having a top side of North polarity and a bottom side of South polarity. The coupling shaft 37 and the shaft magnet 39 are contained within a hollow extended portion 41 of the actuator case 35 and allowed to reciprocate therein with the movement of the armature 31.

The extended section of the case 35 is then closely surrounded by a tubular cavity, represented by a cylinder 43, formed with its wall 44 in the bottom of the movable contact carrier 29. Surrounding the movable contact carrier cylinder 43 within the body of the movable contact carrier 29 is a second magnet, the annular movable contact carrier magnet 45. The annular movable contact carrier magnet 45 has a top side with South polarity and a bottom side with North polarity, i.e. opposite that of the shaft magnet 39. The movable contact carrier 29 and the actuator case 35 are thus slidably coupled and connected during normal operation only by the magnetic attraction of shaft magnet 39 and movable contact carrier magnet 45 when the two magnets 39, 45 opposite faces are aligned.

In this normal case the movable contact carrier 29 will follow at a first position in relation to, and in common with, the movement of the actuator's coupling shaft 39 to close or open the contacts as the actuator moves up and down, respectively, upon activation and deactivation of the coil 33. If this magnetic bond is broken, say by the contacts blowing open under the force of a short circuit current, the movable contacts 23 will carry the movable contact carrier's cylinder 43 upward to a position where the two magnets 39, 45 similar poles are aligned and there the repulsive magnetic forces will hold the contacts 23, 25 apart in a second position relational to one another (i.e. movable contacts up) even though the armature 31 remains in the down position.

In FIG. 1 the coil is activated and the armature is closed (down) and the contacts are closed (together). This is the normal ON position, where the load is thus being supplied with electrical current. In this position the permanent magnets of bistable coupling are oriented so their poles attract one another, providing a link in the first relational position between the movable contact carrier and the actuator armature.

In FIG. 2, the armature is up and the contacts are open, i.e. the normal OFF position. Here the permanent magnet's poles are still in a position to attract one another, as in the closed position of FIG. 1.

In FIG. 3, the armature is closed and yet the contacts are open. This is the blown open or "tripped" position that would be adopted due to electromagnetic repulsive forces during the short circuit current event. The repulsive magnetic forces pushing the contacts apart are sufficient to overcome the link provided by the permanent magnets and place movable contacts in a second relational position to the coupling shaft. The moveable contact carrier 29 is pushed into a "tripped" position where the poles of the permanents magnets are repelling one another. This magnetic repulsion keeps the contacts separated after the repulsive electromagnetic short circuit forces stop, e.g. due to current interruption from a fuse or circuit breaker, no matter what the movement of the coupling shaft 37 may be. The contacts are thus allowed to cool before coming together again, preventing any welding of molten surfaces.

After the short circuit is interrupted by the upstream protective device (e.g. circuit breaker or fuse), the contactor would need to be reset to the normal OFF position (FIG. 2), prior to use.

Figure 4:
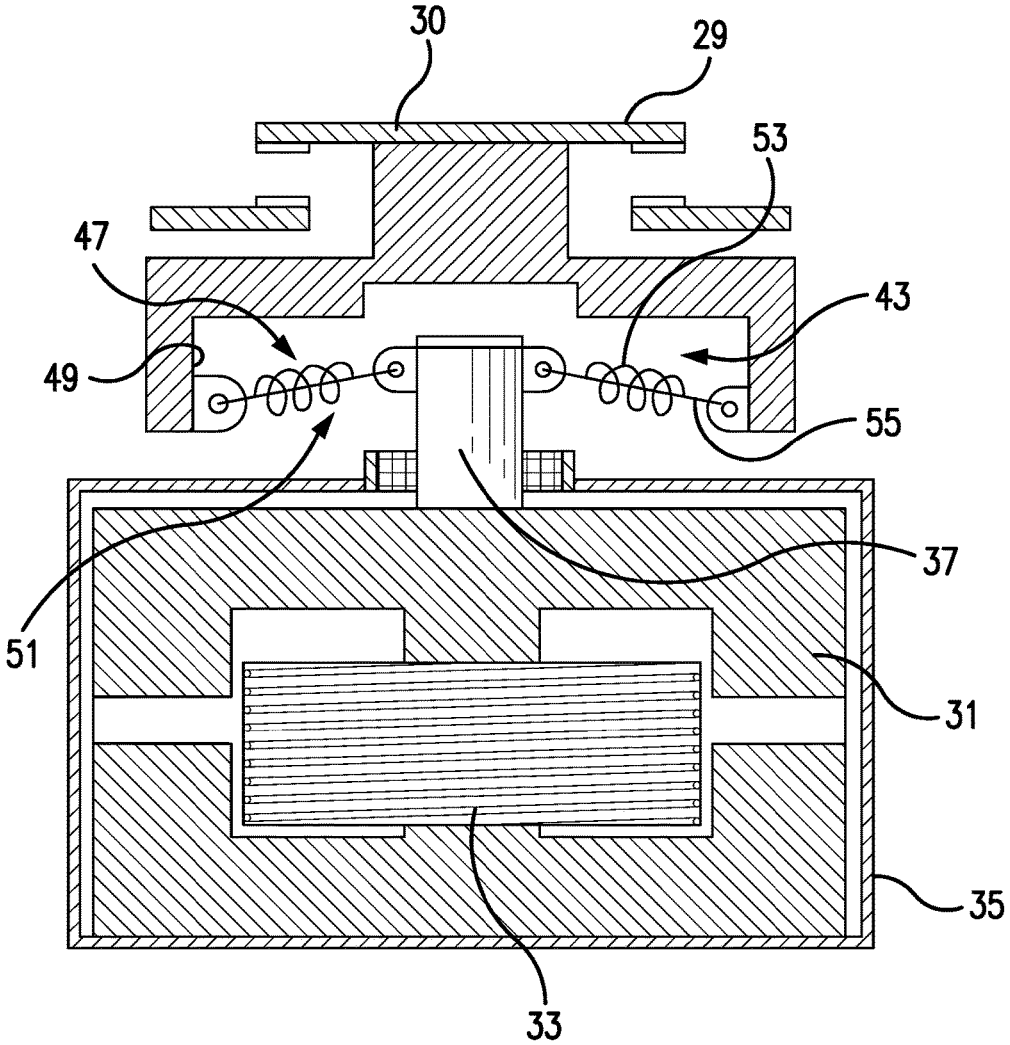
FIG. 4 is an alternative embodiment of a contactor actuator of the present invention in the open, i.e. OFF, position.

As seen in FIG. 4, another aspect of the present invention could involve replacing the magnetic link of FIGS. 1-3 with a mechanical over-center mechanism 47 to establish the bistable connection between the coupling shaft 39 of the armature 31 and the inner wall 49 of a cylindrical void 51 in the bottom surface of the movable contact carrier 29. The coupling shaft 37 and the movable contact carrier 29 are restructured to accommodate the connections of the mechanical over-center mechanism 47 but otherwise the actuator 21 utilizes basically the same construction. The over-center mechanism 47 has springs 53 and linkages 55 having one end attached to the coupling shaft 39 and the other end connected to the inside cylinder wall 49 but would otherwise be the functional equivalent for the magnetic bistable connection of the previous Figures.

While particular aspects, implementations, and applications of the present disclosure have been illustrated and described, it is to be understood that the present disclosure is not limited to the precise construction and compositions disclosed herein and that various modifications, changes, and variations may be apparent from the foregoing descriptions without departing from the invention as defined in the appended claims.

The invention claimed is:

1. An electromagnetically controlled actuator or an electrical contactor comprising:

a) a set of fixed contacts for electrical coupling to a power source and a load;

b) a movable contact carrier with contacts on a top side for meeting the fixed contacts and a body forming a cavity on a bottom side, the cavity having a wall;

c) an actuator with a coil and i) a movable armature actuated by the coil, and ii) a coupling shaft fixedly attached to the armature and extending upwardly therefrom toward the movable contact carrier, and d) a bistable coupling mechanism for holding the coupling shaft in one of two positions in relation to the cavity wall on the bottom side of the movable contact carrier, wherein the two positions include a first position, which is a normal operation position of the movable contact carrier and a second position, which is a blown open position of the movable contact carrier.

2. The electromagnetically controlled actuator of claim 1 wherein the first position allows the movable contacts to touch the fixed contacts and the second position does not allow the movable contacts to touch the fixed contacts.

3. The electromagnetically controlled actuator of claim 1 wherein the bistable coupling mechanism is magnetic.

4. The electromagnetically controlled actuator of claim 3 further comprising:

the cavity wall of the movable contact carrier having a magnet therein with a top side of south polarity and a bottom side of north polarity, and the coupling shaft of the armature having a magnet thereon with a top side of north polarity and a bottom side of south polarity.

5. The electromagnetically controlled actuator of claim 4 wherein the coupling shaft, the armature, and the coil are surrounded by a case.

6. The electromagnetically controlled actuator according to claim 5 further comprising the cavity of the movable contact carrier fitting over an extended portion of the actuator case containing the actuator coupling shaft.

7. The electromagnetically controlled actuator of claim 1 wherein the bistable coupling mechanism is an over-center mechanism with springs and linkages having one end attached to the coupling shaft and the other end connected to the cavity wall of the movable contact carrier.

8. The electromagnetically controlled actuator according to claim 1 further comprising a load controlled by the fixed contacts.

9. The electromagnetically controlled actuator according to claim 8 wherein the load is a motor.

* * * * *